United States Patent [19]

Eki et al.

[11] 4,153,198

[45] May 8, 1979

[54] ELECTRO-HYDRAULIC GOVERNOR EMPLOYING DUPLEX DIGITAL CONTROLLER SYSTEM

[75] Inventors: Yurio Eki; Yasuhiro Tennichi; Naganobu Honda, all of Hitachi, Japan

[73] Assignee: Hitachi, Ltd., Japan

[21] Appl. No.: 764,647

[22] Filed: Feb. 1, 1977

[30] Foreign Application Priority Data

Feb. 4, 1976 [JP] Japan ..... 51-10385

[51] Int. Cl.[2] ..... G06F 15/46; G06F 11/00

[52] U.S. Cl. ..... 235/303.3; 235/307; 364/101; 364/494

[58] Field of Search ..... 235/153 AE, 153 AK, 235/150.1, 303.3, 303.4, 307; 364/101, 102, 119, 492, 494

[56] References Cited

U.S. PATENT DOCUMENTS

| | | | |
|---|---|---|---|
| 3,303,474 | 2/1967 | Moore et al. | 235/153 AE X |
| 3,636,331 | 1/1972 | Amrehn | 235/153 AE X |
| 3,688,099 | 8/1972 | Buscher | 235/303.3 |
| 4,032,757 | 6/1977 | Eccles | 364/101 |
| 4,037,088 | 7/1977 | Davis et al. | 364/494 |
| 4,057,715 | 11/1977 | Jones et al. | 364/494 |

*Primary Examiner*—Felix D. Gruber

*Attorney, Agent, or Firm*—Craig & Antonelli

[57] ABSTRACT

An electro-hydraulic governer employing a duplex digital controller system for the optimum speed control of a steam turbine running with increasing speed in the starting stage or under load. Each of the digital controllers is operable with both a control mode and a stand-by mode, and when one of the digital controllers is placed in the control mode for controlling the rotating speed of the turbine, the other is placed in the stand-by mode to prepare for possible failure of the controller operating with the control mode. A failure detecting unit detects failure of the digital controller operating with the control mode. An output switching unit disconnects the faulty digital controller from the control system and switches over the operating mode of the stand-by digital controller from the stand-by mode to the control mode for the continuous control of the rotating speed of the turbine. A display is provided on an operator's console to display the outputs of these two digital controllers, and the faulty digital controller is detected by non-coincidence of the displayed information. The faulty digital controller having been disconnected from the control system by the output switching unit is repaired as quickly as possible, and after necessary repair, it stands by to prepare for possible failure of the other controller operating with the control mode.

26 Claims, 17 Drawing Figures

ELECTRO-HYDRAULIC GOVERNOR EMPLOYING DUPLEX DIGITAL CONTROLLER SYSTEM

This invention relates to an electro-hydraulic governor used for the control of the rotating speed of a turbine running with increasing speed in the starting stage or under load, and more particularly to a duplex electro-hydraulic governor employing a duplex digital controller system for the optimum speed control of a steam turbine.

Governors are used for the control of the rotating speed of steam turbines in which the thermal energy carried by steam under high pressure is converted into the corresponding mechanical energy. It is the recent tendency to employ electro-hydraulic governors more frequently than the conventional mechano-hydraulic ones for this purpose. Electro-hydraulic governors are classified into an analog type and a digital type, and as is commonly acknowledged, the latter type is advantageous over the former type from the viewpoints of controllability and economy owing to the remarkable progress of digital computers. It is true that modern digital computers themselves can operate with high reliability, but the reliability thereof is still not fully satisfactory for use with the electro-hydraulic governors of the digital type which should be absolutely fail-proof. Various digital computer systems including a dual system, a duplex system and a two-out-of-three system are presently considered for the purpose of improving the reliability of the digital computers. The two-out-of-three system, however, is not suitable from the economical aspect since three digital computers are required. The dual system includes a pair of central processor units which are arranged for parallel operation and associated with a single, common, process input/output unit. In the dual system, the two central processor units are always synchronized for carrying out the same processing. These two central processor units are connected to the process input/output unit through a failure monitoring unit which monitors the data inputs and outputs of the central processor units. In the dual system, however, the failure monitoring unit provided for the purpose of monitoring the data inputs and outputs of the central processor units is quite complex in structure, and the scale of hardware of this failure monitoring unit is as large as that of the central processor units. That is, the failure monitoring unit is too costly to be incorporated in the dual system unless the scale of the system is larger than a certain limit. In a recently frequently employed digital computer of small scale, its central processor unit is composed of a single or a few printed circuit boards. In such a small-scale digital computer, the scale of its process input-/output unit is rather larger than that of the central processor unit, and the reliability of the central processor unit is also rather higher than that of the process input/output unit. It is therefore meaningless to compose a pair of such central processor units only into a dual system. The reliability of the process input/output unit is especially important in a system such as a steam turbine control system in which failure of the process input/output unit leads directly to an accident such as turbine tripping.

Therefore, in a control system of small scale used for the control of the rotating speed of a turbine running with increasing speed in the starting stage or under load, it is sometimes desirable to provide a duplex arrangement of both the central processor units and the process input/output units. Especially, when a pair of digital computers of small scale are used for the control of a steam turbine plant, the duplex system is more advantageously employed in which each digital computer comprises a central processor unit, a process input unit and a process output unit, and one of the digital computers is selected to apply its output to the steam turbine plant.

In the conventional duplex system, however, the stand-by digital computer is generally placed in shut-down state, and the continuous control is temporarily interrupted during switch-over between the digital computers. Since this interruption of continuous control is undesirable for the electro-hydraulic governor of digital type, it is preferable to adopt a special duplex system in which the stand-by digital computer is also placed in continuous operation. This special duplex system comprises a first digital controller consisting of a first central processor unit, a first process input unit and a first process output unit, and a second digital controller consisting of a second central processor unit, a second process input unit and a second process output unit. The detected values of various controlled variables of a steam turbine plant and the settings of various controlled variables set by the operator on an operator's console are applied from each process input unit to the associated central processor unit to be subject to predetermined processing. The process output units apply the values obtained by the processing in the associated central processor units to an output switching unit which selects one of the outputs of the process output units and applies the selected output to the steam turbine plant for controlling the rotating speed of the turbine. When one of the first and second digital controllers fails to properly operate, the output of the faulty digital controller is switched over to that of the sound one by the output switching unit. In this case, the switching operation by the output switching unit must be done at exact timing under control of a switching instruction signal. In the duplex system, therefore, a failure detecting unit is essentially required which is capable of reliably detecting failure of either digital controller and applies a switching instruction signal to the output switching unit. When one of the two digital controllers is faulty, such faulty digital controller must be repaired as quickly as possible. Suppose, for example, that failure occurs in the second digital controller. In such a case, even when the control for the system is switched over to the first digital controller, it is extremely difficult to repair the faulty part unless the second digital controller is disconnected from the control system. However, this disconnection is impossible due to the fact that the input signals from the operator's console and controlled turbine plant are electrically connected to the first and second digital controllers. Further, the disconnection leaves a hot line which will affect adversely the normally operating first digital controller to render it incapable of normal operation or which may give rise to danger such as an electrical shock to the operator. Furthermore, when the duplex system is left non-maintained without any repair, the mean time between failures (MTBF), that is, the length of time in which the duplex system maintains its normal function will be only about 1.5 times that of the simplex system. Therefore, the duplex system must be so maintained as to permit ready repair, and this increases greatly the mean time between failures and improves the reliability of the control system although it is dependent upon the length of time required for repair.

It is an object of the present invention to provide an electro-hydraulic governor comprising a pair of digital controllers composing a duplex system and each including a central processor unit, a process input unit and a process output unit for controlling the rotating speed of a steam tubine, in which the two digital controllers are continuously run while checking the rationality of inputs with their central processor units, and which comprises further a failure detecting unit for detecting an abnormal operation to identify whether the abnormal operation is attributable to failure of the steam turbine or failure of the process input or output unit, thereby switching over the faulty output to the normal output when one of the digital controllers is found faulty.

Described more specifically, each digital controller is operable with both a control mode and a stand-by mode so as to minimize disturbance occurring during switchover between the faulty digital controller and the sound one.

Another object of the present invention is to provide an electro-hydraulic governor of the above character in which means are provided so that, in conjunction with the detection of failure in one of the digital controllers by the failure detecting unit, the faulty digital controller can be repaired to be restored to the original on-line position as quickly as possible.

Described more specifically, outputs appearing from the first and second digital controllers in response to the application of an input from an operator's console are displayed on the operator's console to permit ready detection of failure of either digital controller when the displayed outputs do not coincide with each other. After making necessary repair on the faulty digital controller, the displayed outputs of the first and second digital controllers are rendered coincident with each other to bring coincidence between the internal states of these digital controllers, that is, the information stored in their memories, so that the repaired digital controller can be properly restored to the on-line position.

The above and other objects, features and advantages of the present invention will become more apparent from the following detailed description taken in conjunction with the accompanying drawings, in which.

Figure 1:
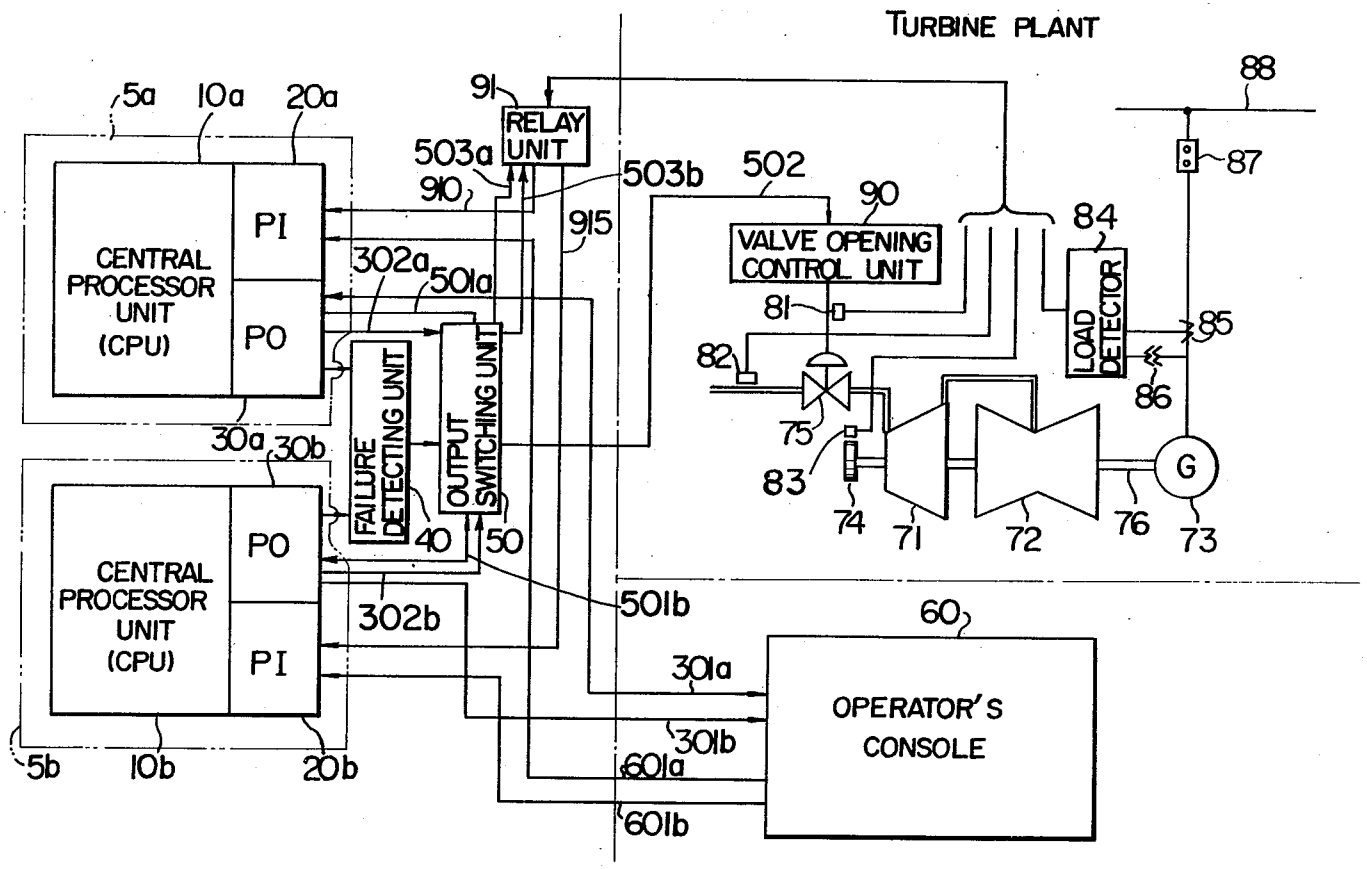
FIG. 1 is a block diagram showing the basic concept of the present invention which comprises a pair of digital controllers applied for the control of a steam turbine plant system.

The present invention is applied to an electro-hydraulic governor used for controlling the rotating speed of a steam turbine. FIG. 1 shows schematically an application of an embodiment of the present invention to a steam turbine plant system. A pair of digital controllers 5*a* and 5*b* comprise central processor units (CPU) 10*a*, 10*b*, process input units (PI) 20*a*, 20*b*, and process output units (PO) 30*a*, 30*b*, respectively. A failure detecting unit 40 is provided in common to the two digital controllers 5*a* and 5*b* for monitoring the same against an abnormal operation. An output switching unit 50 is actuated by the output of the failure detecting unit 40 to switch over between the outputs of the process output units 30*a* and 30*b*. Various controlled variables of the turbine plant system are set on an operator's console 60 by the operator, and, at the same time, the operating states of the digital controllers are continuously displayed on various display elements provided on the operator's console 60. The turbine plant system comprises a high pressure turbine 71, an intermediate and low pressure turbine 72, an electric generator 73, a gear 74, and a main steam flow regulating valve 75. A detector 81 detects the valve opening of the regulating valve 75, and another detector 82 detects the pressure of main steam. The rotating speed and load of the turbine are detected by detectors 83 and 84 respectively. The reference numerals 85, 86, 87 and 88 designate a potentiometer transformer, a current transformer, a main circuit breaker, and an electric power system, respectively. A regulating valve opening control unit 90 controls the valve opening of the regulating valve 75 in response to the application of a regulating valve actuating signal from the output switching unit 50. Signals representing the results of detection by the detectors 81 to 84 are applied to a relay unit 91 which applies the corresponding signals to the digital controllers 5*a* and 5*b*. The operation of these units will be described with reference to FIG. 1.

Each of the digital controllers 5*a* and 5*b* is operable with both a control mode and a stand-by mode. The control mode refers to a mode in which the result of processing provides a turbine speed control signal. The stand-by mode refers to a mode in which the result of processing determines the initial value to be used in processing in the control mode. Therefore, when the digital controller 5*a* is placed in the control mode, the output signals 302 of the digital controller 5*a* is selected by the output switching unit 50 to be applied as output signals 502 to the regulating valve opening control unit 90 as a regulating valve actuating signal. On the other hand, the digital controller 5*b* is now placed in the stand-by mode to prepare for possible failure of the digital controller 5*a*. Thus, upon occurrence of failure of the digital controller 5*a* operating with the control mode, the failure detecting unit 40 detects the failure and applies a digital controller output switching instruction signal to the output switching unit 50. In response to the application of this instruction signal, the output switching unit 50 acts to provide output signals 501*a* and 501*b* to switch over the output of the digital controller 5*a* placed in the control mode to the output of the digital controller 5b having been placed in the stand-by mode. At the same time, the digital controller 5a is disconnected from the control system, and the operating mode of the digital controller 5b is switched over from the stand-by mode to the control mode. In this case, the initial value used in processing in the digital controller 5b placed now in the control mode is determined by the result of processing carried out while it is placed in the stand-by mode. In this manner, the output signal 302b of the digital controller 5b is now selected after the switch-over by the output switching unit 50, and this output is applied to the regulating valve opening control unit 90 as the regulating valve actuating signal. If the digital controller 5b thus operating with the control mode fails to properly operate thereafter, this digital controller 5b is disconnected from the control system, and the operating mode of the digital controller 5a cleared of failure is switched over from the stand-by mode to the control mode.

Figure 2:
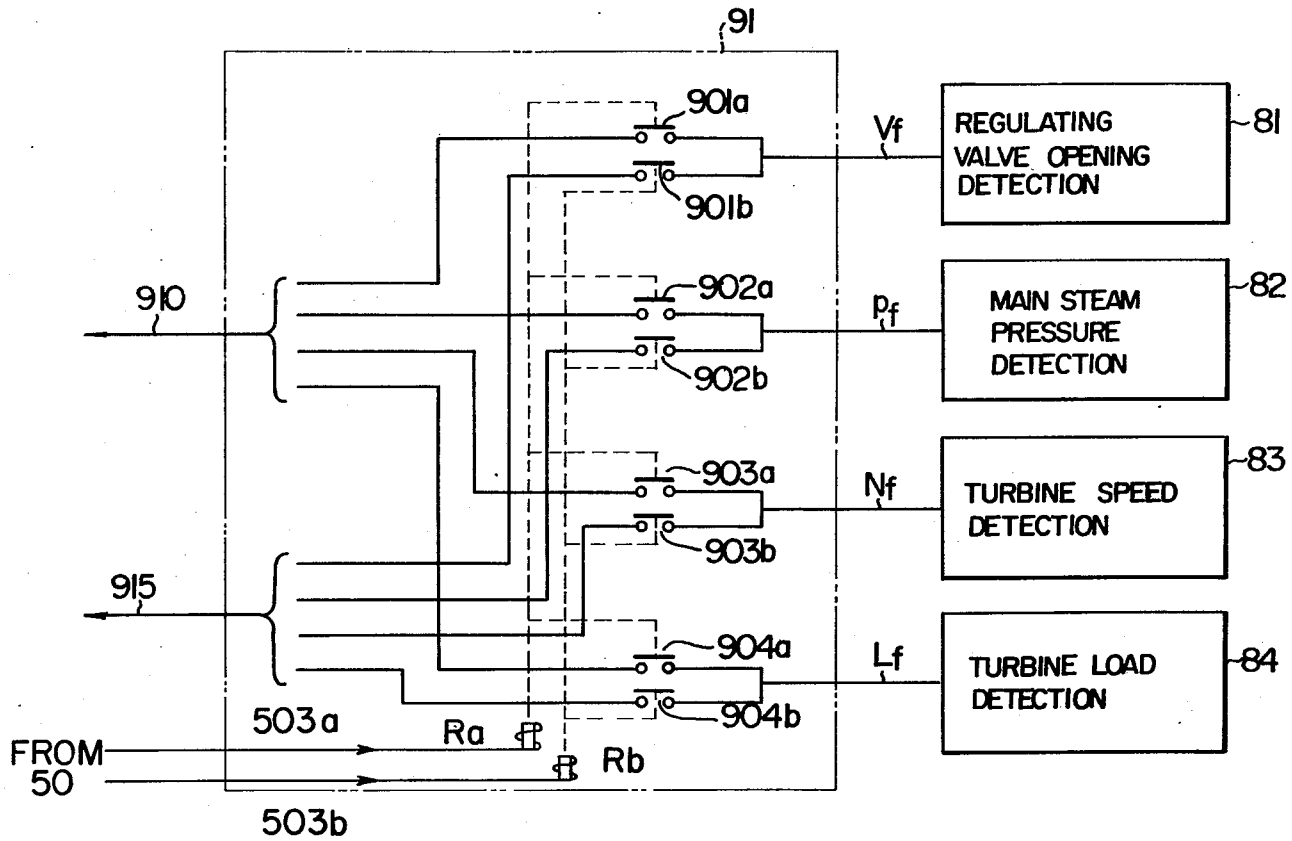
FIG. 2 is a digrammatic view showing in detail the structure of the relay unit shown in FIG. 1.

Various settings set by the operator on the operator's console 60 and various controlled variables detected in the turbine plant system are applied to the digital controllers 5a and 5b. The operator sets the turbine rotating speed $N_s$, turbine load $L_s$ and speed regulation $\delta$ on the operator's console 60. In the turbine plant system, on the other hand, the regulating valve opening $V_f$, main steam pressure $P_f$, turbine rotating speed $N_f$ and turbine load $L_f$ are detected. Signals representing these actually detected values are applied to the digital controller 5a or 5b through the relay unit 91 which has a structure as shown in FIG. 2. The relay unit 91 comprises a plurality of contacts which transmit detector output signals 910 to the digital controller 5a separately from detector output signals 915 transmitted to the digital controller 5b, so that the former signal transmission path can be electrically isolated from the latter in the event of failure. More precisely, referring to FIG. 2, the relay unit 91 comprises a group of normally closed contacts 901a to 904a and another group of normally closed contacts 901b to 904b, and the contacts in each group are arranged for ganged operation. These contacts are, for example, mercury relay contacts which can operate reliably at a high speed. Therefore, when the contacts of one of the groups in the relay unit 91 are deenergized in ganged relation with the relay contact switching operating of the output switching unit 50 operating in conjunction with relays $R_a$ and $R_b$ via signals 503a and 503b, respectively, a faulty one of the digital controllers 5a and 5b can be completely electrically disconnected from the control system. To this end, independent power sources are provided for the individual digital controllers 5a and 5b so as to permit to temporarily disconnect one of the digital controllers 5a and 5b from the control system by cutting off the power supply associated with that digital controller. This is an absolutely necessary function as described later in order to make necessary repair on the faulty digital controller for restoring the same to the original on-line position. In response to the application of the signals representing the settings and detected controlled variables, the digital controllers 5a and 5b process these data to compute the optimum valve opening of the regulating valve 75. When the digital controller 5a or 5b is placed in the control mode, the result of processing in this digital controller 5a or 5b is selected by the output switching unit 50 to be applied to the regulating valve opening control unit 90 as the valve actuating signal. At the same time, the internal states of the individual digital controllers 5a and 5b are displayed on the operator's console 60. The structure and operation of various parts will now be described in detail.

(1) Turbine Plant

The structure and operation of the turbine plant will be described with reference to FIG. 1. Steam generated in the boiler is supplied to the turbine plant through the main steam flow regulating valve 75. The valve opening of this regulating valve 75 is determined by the regulating valve opening control unit 90 for controlling the quantity of main steam admitted into the turbine plant. The actual valve opening $V_f$ of the regulating valve 75 is detected by the regulating valve opening detector 81. The main steam pressure detector 82 disposed on the boiler side of the regulating valve 75 detects the actual pressure $P_f$ of main steam. After passing through the regulating valve 75, main steam makes necessary work in the high pressure turbine 71, and then, in the intermediate and low pressure turbine 72 before being exhausted into the condenser. The electric generator 73 and gear 74 are coupled directly to the turbine shaft 76. The generator 73 converts the mechanical energy produced in the turbine plant into the corresponding electrical energy to feed the same into the electric power system 88. The rotating speed of the gear 74 rotating with the turbine shaft 76 is detected by the turbine speed detector 83 disposed adjacent to the gear 74 to detect the actual rotating speed $N_f$ of the turbine. The terminal voltage and current of the generator 73 are detected by the potentiometer transformer 85 and current transformer 86 respectively, and on the basis of these detected values, the turbine load detector 84 detects the actual load $L_f$ of the turbine. Signals representing these detected values $V_f$, $P_f$, $N_f$ and $L_f$ are applied through the relay unit 91 to the digital controllers 5a and 5b. In response to the application of these signals, the digital controllers 5a and 5b compute a new valve opening, and the output of the digital controller, which is placed in the control mode, is selected by the output switching unit 50 to be applied to the regulating valve opening control unit 90 as the valve actuating signal.

(2) Operator's Console

The operator's console 60 comprises a plurality of analog display elements 61, a plurality of display elements 62 with push button switch, a plurality of simple display elements 63, and a digital display element 64. The displaying face of each of the push button switch actuated display elements 62, except those with the symbol *, is divided into an upper half and a lower half for indicating the operating states of the digital controllers 5a and 5b respectively.

A speed setting display element 621 with push button switch, a load setting meter 611, and a load increase display element 620 with push button switch shown in FIG. 3 will be taken as examples of the multiple display elements, and their functions will be described with reference to FIG. 4.

Figure 4:
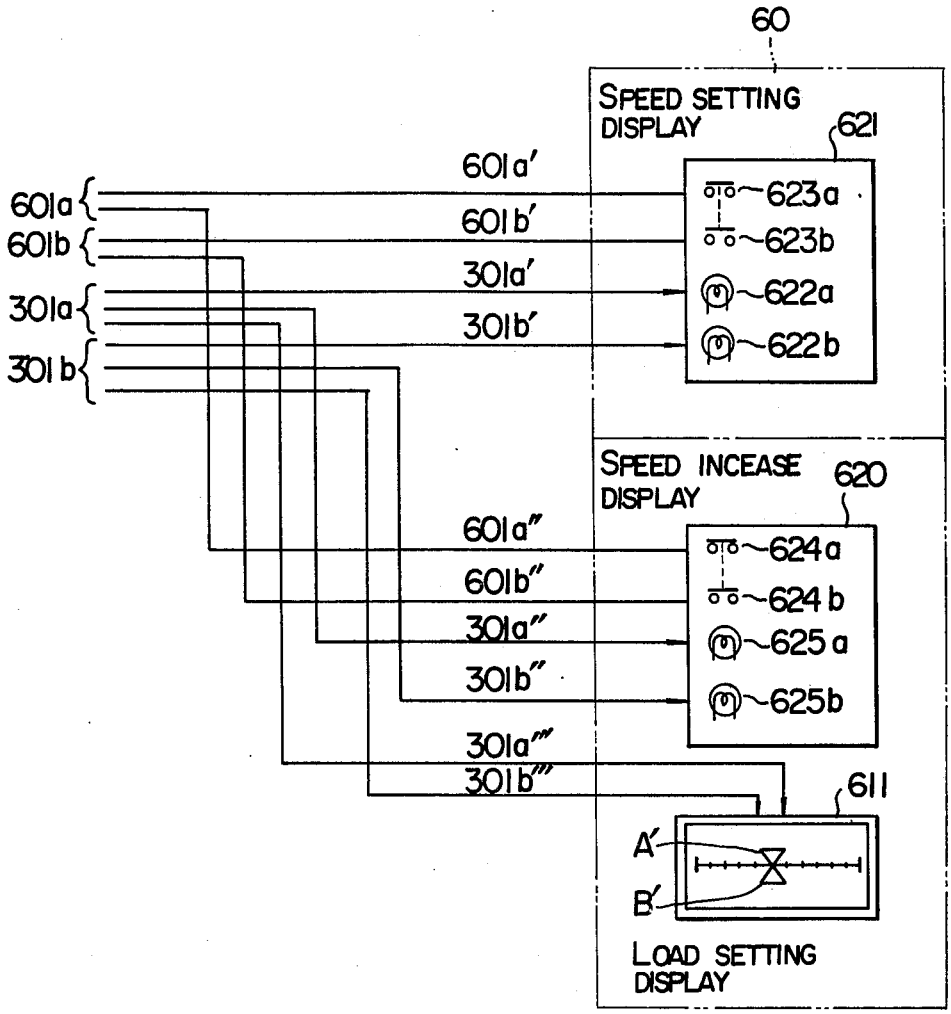
FIG. 4 is a diagrammatic view showing in detail the structure of some of the display elements shown in FIG. 3.

In the case of the speed setting display element 621 provided with a push button switch which is turned on and off, signals 601a' and 601b' produced by the turn-on of the push button switch are applied to the process input units 20a and 20b of the digital controllers 5a and 5b as signals 601a and 601b respectively, as shown in FIG. 4. In response to the application of these signals 601a and 601b, to the digital controllers 5a and 5b, signals 301a and 301b appear from the process output units 30*a* and 30*b* of the digital controllers 5*a* and 5*b* to be applied to the display element 621 as signals 301*a*′ and 301*b*′ which energize display lamps 622*a* and 622*b* respectively.

Figure 3:
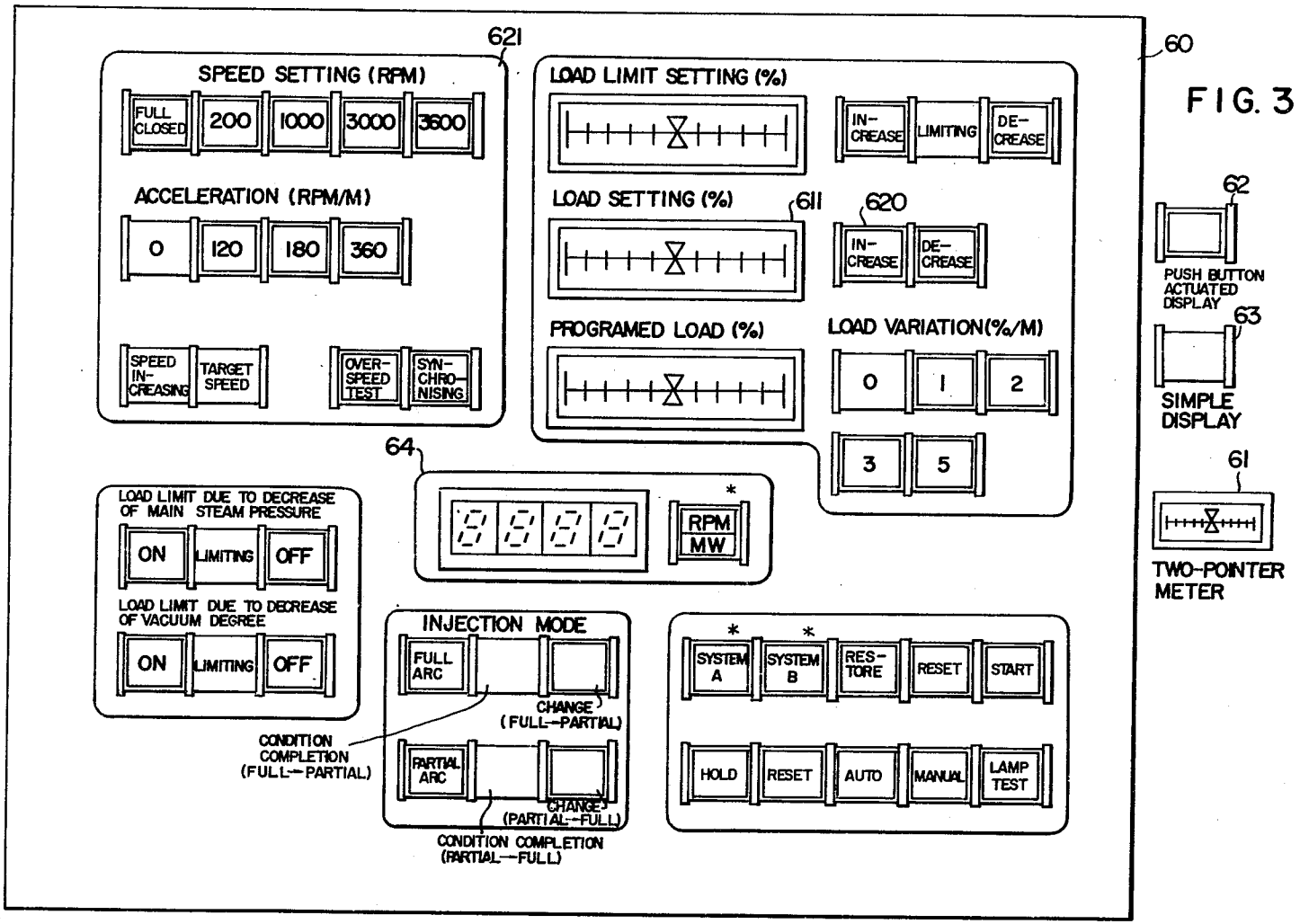
FIG. 3 is a front elevational view showing arrangement of display elements with push button, analog display elements, etc. on the operator's console shown in FIG. 1.

The load setting, load limit setting or like analog value is set by energizing a push button actuated display element and an analog display element such as those shown by 620 and 611 in FIG. 3. In response to the depression of the push button switch of the load increase display element 620, signals 601*a*″ and 601*b*″ appear to be applied to the process input units 20*a* and 20*b* of the digital controllers 5*a* and 5*b* as signals 601*a* and 601*b* respectively. The digital controllers 5*a* and 5*b* scan these signals with a short sampling period, and the value proportional to the duration of depression of the push button switch is stored in an internal memory of each digital controller. Signals 301*a* and 301*b* each representing this value are applied from the process output units 30*a* and 30*b* of the digital controllers 5*a* and 5*b* to be displayed on the analog display element 611. The depression of the push button switch is displayed by display lamps which are kept lit during the length of time in which the push button switch is continuously depressed.

Figure 5A:
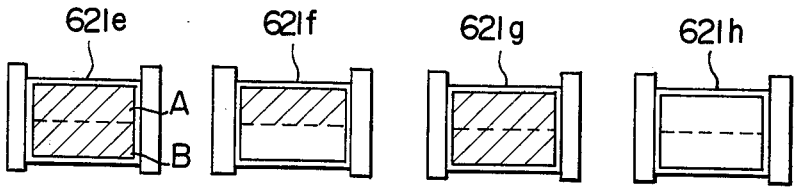
FIGS. 5A to 5D illustrate the operating state of the digital controllers shown in FIG. 1 and the displaying state of the push botton actuated display elements shown in FIG. 3.
Figure 5B:
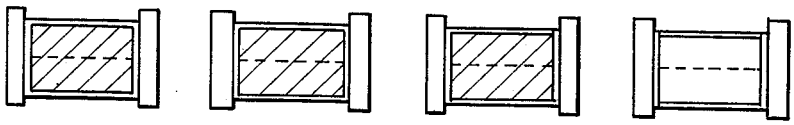

Describing in more detail, the speed setting display element 621 provided with the push button switch comprises a pair of contacts 623*a*, 623*b* and a pair of display lamps 622*a*, 622*b*. In response to the depression of the push button switch of the display element 621, the contacts 623*a* and 623*b* are turned on to apply signals 601*a*′ and 601*b*′, hence signals 601*a* and 601*b*, to the central processor units 10*a* and 10*b* through the process input units 20*a* and 20*b* respectively. In response to the application of the signals 601*a* and 601*b* to the central processor units 10*a* and 10*b*, response signals 301*a* and 301*b* appear from the process output units 30*a* and 30*b* to be applied to the display element 621 as signals 301*a*′ and 301*b*′ which energize the display lamps 622*a* and 622*b* respectively. Therefore, when the first and second digital controllers 5*a* and 5*b* are normally operating, the visual display given by the display lamp 622*a* coincides necessarily with that given by the display lamp 622*b*. There are a plurality of such display elements 621 although the number of them is dependent upon the scale of the turbine plant system. In FIGS. 5A–5D four such display elements 621*e* to 621*h* are illustrated by way of example, and the symbols A and B are used to indicate the display areas concerned with the digital controllers 5*a* and 5*b* respectively. FIG. 5A illustrates that an abnormal situation occurs during the continuous operation of the first and second digital controllers 5*a* and 5*b*. More precisely, occurrence of an abnormal situation in one of the first and second digital controllers 5*a* and 5*b* is detected from the fact that the display lamp in the display area B of the display element 621*f* is not energized although the display lamp in the display area A is energized. FIG. 5B illustrates displaying states of the display lamps when both the first and second digital controllers 5*a* and 5*b* under operation are normally continuously operating. Referring to FIG. 5B, the two display lamps of all the display elements give the same display, and this proves the fact that the internal memories of the central processor units 10*a* and 10*b* have the same contents.

Figure 5C:
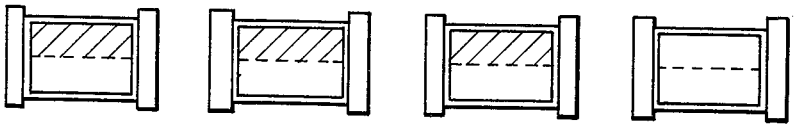
Figure 5D:
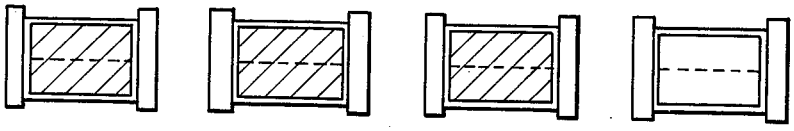

In the event of occurrence of failure in one of the first and second digital controllers 5*a* and 5*b*, the faulty digital controller must be immediately disconnected from the control system for necessary repair. During making necessary repair on the faulty digital controller, the normal one continues to operate. In such a case, the display lamps associated with the normally operating digital controller are solely energized as shown in FIG. 5C. At the end of the necessary repair on the faulty digital controller, the contents of the internal memory of the central processor unit of the digital controller is not necessarily the same as those of the internal memory of the central processor unit of the normal digital controller operating on line. It is therefore necessary to establish coincidence between the data supplied to the digital controllers 5*a* and 5*b* from the operator's console 60 before the repaired one is restored to the original on-line position. This is simply done by depressing the push button switches of the display elements 621*e* to 621*g* in which only those display lamps associated with the normal digital controller are energized in FIG. 5C. In response to the depression of these push button switches, necessary data are supplied to the central processor unit of that digital controller which is to be restored to the on-line position, and the result of data reading is displayed by the display lamps of the display elements. That is, the display lamps associated with the depressed push button switches are energized as shown in FIG. 5D to give the same indication for the two digital controllers. Therefore, the coincidence of the contents of the internal memories of the central processor units 10*a* and 10*b* can be visually confirmed, and thereafter, the repaired digital controller can be restored to the original on-line position.

Various control conditions are set as analog quantities in a manner as described below. Various control settings include, for example, the target load of the turbine. Therefore, the load setting meter 611 and load increase display element 620 will be described by way of example.

Figure 6A:
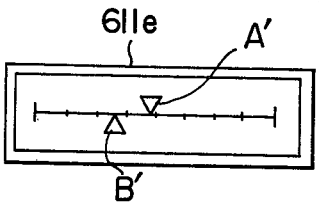
FIGS. 6A to 6D illustrate the operating state of the digital controllers shown in FIG. 1 and the displaying state of one of the analog display elements shown in FIG. 3.
Figure 6B:
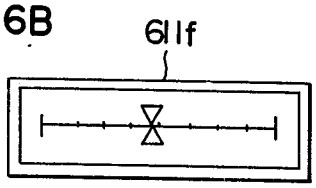
Figure 6C:
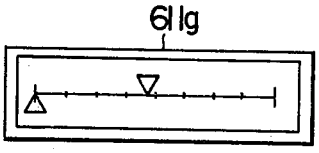
Figure 6D:
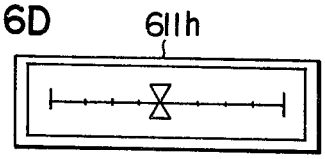

Referring to FIG. 4 again, the load increase display element 620 comprises a pair of push button switches 624*a*, 624*b* and a pair of display lamps 625*a*, 625*b*. These push button switches 624*a* and 624*b* are used to supply analog data to the central processor units 10*a* and 10*b* through the process input units 20*a* and 20*b* respectively. The data set in the internal memories of the central processor units 10*a* and 10*b* are variable depending on the duration of depression. In FIG. 6, the symbols A′ and B′ designate a pair of pointers associated with the digital controllers 5*a* and 5*b* respectively. The central processor units 10*a* and 10*b* are so programmed that the data set in their internal memories can be displayed by the pointers A′ and B′ of the meter 611 through the medium of signals applied from the process output units 30*a* and 30*b* respectively. Therefore, when both the digital controllers 5*a* and 5*b* are normally continuously operating, the pointers A′ and B′ point necessarily to the same position as seen in FIG. 6B. FIG. 6A illustrates the case in which an abnormal situation occurs in one of the first and second digital controllers 5*a* and 5*b* during continuous operation, and it will be seen that the indication by the first pointer A′ does not coincide with that by the second pointer B′. In this case, the faulty digital controller must be immediately disconnected from the control system for necessary repair. When the faulty digital controller is so disconnected, the pointer associated with the faulty digital controller is reset on the meter 611 as seen in FIG. 6C. Before restoring the repaired digital controller to the original on-line position, the push button switch 620 in FIG. 4 is depressed to bring coincidence between the positions of the pointers A' and B' on the meter 611 as seen in FIG. 6D. That is, the repaired digital controller is restored to the original on-line position after brining coincidence between the contents of the internal memory of the central processor unit of the sound digital controller and those of the repaired digital controller to be restored to the on-line position.

The operator's console 60 shown in FIG. 4 is illustrated as having such an arrangement that various data are set on the basis of analog information provided by the on-off or duration of depression of push button switches, by way of example. There are, however, various means for bringing coincidence between the contents of the internal memories of the two central processor units, and the present invention is in no way limited to the specific means illustrated in FIGS. 5 and 6. For example, such information may be provided by ten-key switches, digital switches or the like. Further, various other suitable means such as digital display elements or CRT display elements may be employed for the display of information. These means may be suitably selected depending on the scale, service and application of the turbine plant system.

(3) Digital Controller

As described previously, the digital controllers 5a and 5b comprise central processor units 10a, 10b, process input units 20a, 20b, and process output units 30a, 30b, respectively. Signals representing various settings are applied from the operator's console 60 to the digital controllers 5a and 5b together with signals representing various detected values applied from the turbine plant, and after predetermined processing, the result of processing is applied to the regulating valve opening control unit 90 as a regulating valve actuating signal. Each of the central processor units 10a and 10b comprises a memory part 101, a control part 102 and an arithmetic part 103 and carries out processing of various information inputs according to a predetermined program to provide necessary control information. These central processor units 10a and 10b and the same in structure and operation, and therefore, the structure and operation of the central processor unit 10a will be described with reference to FIG. 7.

Figure 7:
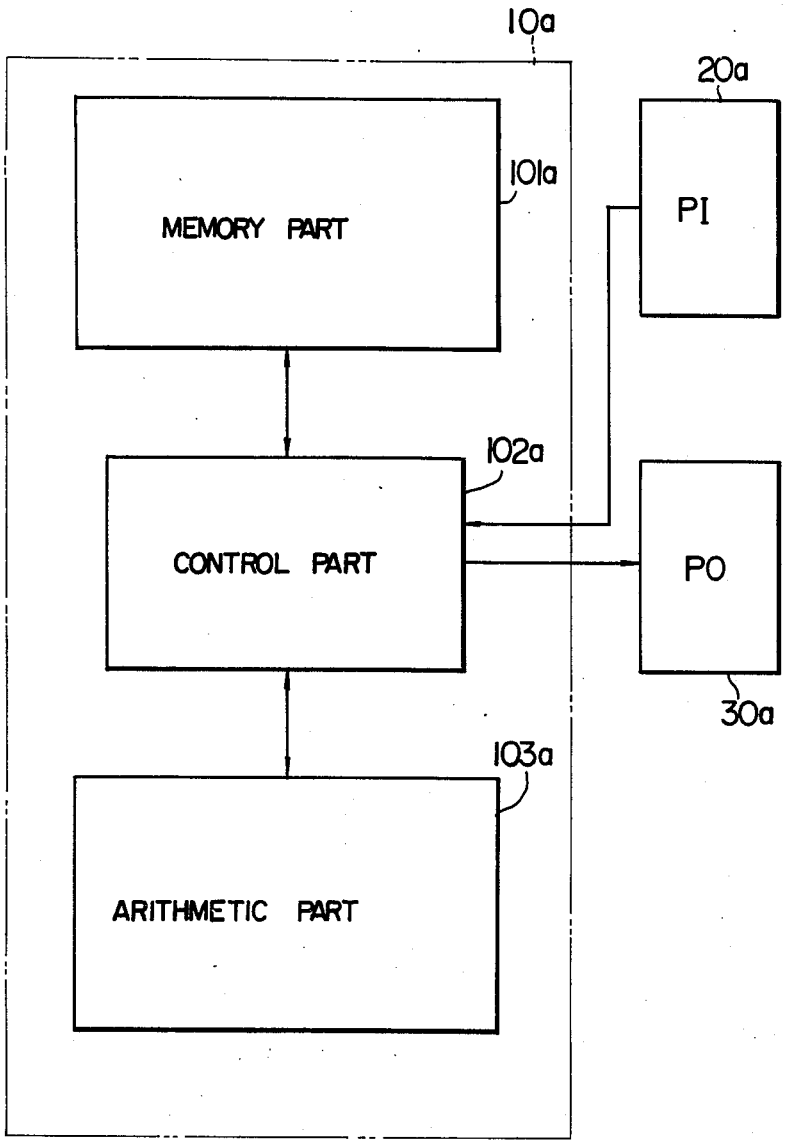
FIG. 7 is a diagrammatic view showing in detail the relation among the central processor unit, process input unit and process output unit constituting each digital controller.

Referring to FIG. 7, the memory 101a stores various settings and detected values applied through the process input unit 20a and has predetermined processing programs therein to deal with the control mode and stand-by mode respectively of the digital controller 5a. The control part 102a acts to suitably derive the stored contents from the memory part 101a for supplying the same to the arithmetic part 103a. The arithmetic part 103a carries out predetermined arithmetic operation on the data supplied from the control part 102a, and the result of computation is fed back to the control part 102a again. Upon reception of the result of computation, the control part 102a supplies the result of computation, as a regulating valve actuating signal, to the regulating valve opening control unit 90 through the process output unit 30a when the digital controller 5a is placed in the control mode. On the other hand, when the digital controller 5a is placed in the stand-by mode, the result of computation is supplied from the control part 102a to the memory part 101a and stored therein to be used as the initial value used in the processing carried out after the switch-over of the operating mode from the stand-by mode to the control mode. Therefore, the manner of processing carried out in the central processor unti 10a in the control mode and stand-by mode will be described in detail at first, and a flow chart employed for the execution of such processing will then be described in detail, by way of example.

(A) Processing in Control Mode and Stand-By Mode

As repeatedly described, the processing carried out in the control mode differs from that carried out in the stand-by mode. The manner of processing carried out in the control mode will be described at first. Whether the steam turbine is running with increasing speed in the starting stage or under load is detected on the basis of various values detected in the turbine plant. When the turbine is detected running with increasing speed in the starting stage, a proportional plus integral value of the error ($N_s$ - $N_f$) between the speed setting $N_s$ and the detected speed value $N_f$ of the turbine is computed by processing so as to determine the flow rate $F_s$ of main steam to be supplied to the turbine. On the other hand, when the turbine is detected running under load, proportional plus integral value of the error ($L_s$ - $L_f$) between the load setting $L_s$ and the detected load value $L_f$ of the turbine is computed, and this value is added to the value obtained by dividing the error ($N_r$ - $N_f$) between the rated speed $N_r$ and the detected speed value $N_f$ of the turbine by the speed regulation $\delta$, so as to determine the flow rate $F_s$ of main steam to be supplied to the turbine.

The manner of processing carried out in the stand-by mode will next be described. When the turbine is detected running with increasing speed in the starting stage, the detected speed value $N_f$ of the turbine is subject to linear transformation with the detected pressure value $P_f$ of main steam, as follows:

$$a(P_f)\cdot N_f+b \qquad (1)$$

where a and b are constants. The detected pressure of main steam is taken into account in the expression (1), since the valve opening of the regulating valve 75 during the speed increasing stage is dependent more or less upon the condition of main steam supply although it is roughly proportional to the rotating speed of the turbine. However, the detected pressure $P_f$ of main steam need not be taken into account when little pressure variation occurs in the turbine plant system. On the other hand, when the turbine is running under load, the detected load value $L_f$ of the turbine is subject to linear transformation with the detected pressure value $P_f$ of main steam, as follows:

$$a'(P_f)\cdot L_f+b' \qquad (2)$$

where a' and b' are constants. Although the valve opening of the regulating valve 75 is roughly proportional to the load of the turbine during running under load, the detected pressure $P_f$ of main steam is also taken into account in the expression (2) since the valve opening is also dependent upon the condition of the main steam supply. In this case too, the detected pressure $P_f$ of main steam need not be taken into account as in the former case when little pressure variation occurs in the turbine plant system. Further, although the second term b' in the expression (2) is specified as a constant, it may not be the constant and a suitable term determined taking into account possible variation in the rotating speed N of the turbine and the speed regulation $\delta$.

The values thus obtained according to the expressions (1) and (2) are stored in the memory part of the digital controller placed in the stand-by mode, so that one of them can be used as the initial value in the processing carried out in the control mode described hereinbefore. Therefore, as soon as the operating mode of the digital controller is switched over from the stand-by mode to the control mode, the value given by the expression (1) or (2) is provided as the initial value used in the processing carried out in the control mode, thereby determining the flow rate $F_s$ of main steam to be supplied to the turbine.

The flow rate $F_s$ computed in the manner above described for each of the control mode and stand-by mode is applied to a step of function generation (158 in FIG. 8B) to be converted into a signal instructing the valve opening $V_s$ of the regulating valve 75. The manner of valve opening control by means of the signal instructing the valve opening $V_s$ of the regulating valve 75 will be described. A proportional plus integral value of the error $(V_s-V_f)$ between the instructed valve opening $V_s$ and the detected valve opening $V_f$ of the regulating valve 75 is converted into a regulating valve actuating signal when the digital controller is placed in the control mode, while a proportional value of the above error $(V_s-V_f)$ is provided as the initial value used in the processing when the digital controller is placed in the stand-by mode, so as to permit humpless switch-over between the digital controllers. Such humpless switch-over between the digital controllers can be attained due to the fact that the value subjected to the linear transformation or the proportional value is the linear transformation or the proportional value is computed in the stand-by mode.

The reason therefor will be described in detail with reference to the valve opening control of the regulating valve 75. The gains of the process input units 20*a* and 20*b* of the digital controllers 5*a* and 5*b* are actually slightly different from each other although they are designed to be the same. Suppose now that A and A' are the gains of the respective process input units 20*a* and 20*b*, $V_s$ is the desired valve opening computed in the control mode, and $V_f$ is the actually detected valve opening of the regulating valve 75. Then, in the steady state, the error E produced in the course of processing in the control mode is zero, and the regulating valve actuating signal $V_d$ to be applied finally to the regulating valve opening control unit 90 is nil. Hence, the following equation holds:

$$E=V_s-A\cdot V_f=0 \tag{3}$$

The actual position of the regulating valve 75 is, therefore, expressed as follows:

$$V_f=V_s/A \tag{4}$$

On the other hand, the error E' produced in the course of processing in the stand-by mode is expressed as follows:

$$E'=V_s-A'\cdot V_f=V_s-V_a/A\times A'=V_s(1-A'/A) \tag{5}$$

When a proportional plus integral value of this error E' is computed as in the control mode, the computed value $V_d'$ of the regulating valve actuating signal in the stand-by mode is given as follows:

$$V_d'=K'\cdot E'+\frac{K'}{TI}\cdot\int E'dt=K'\cdot V_s(1-A'/A)+\frac{K'}{TI}\cdot\int V_s(1-A'/A)\,dt \tag{6}$$

The second term of the equation (6) increases with time although $A'/A\simeq 1$. Therefore, when failure occurs in the digital controller operating with the control mode in a long period of time of operation, and the operating mode thereof is switched over to the stand-by mode, the output of the digital controller having been placed in the stand-by mode, that is, the regulating valve actuating signal $V_d'$ may have such an excessively large value which will impart a considerable disturbance to the controlled turbine plant. In order to avoid such an undesirable situation, the linearly transformed value or the proportional value is employed, instead of the proportional plus integral value, in the case of the digital controller having been placed in the stand-by mode. Thus, the second term in the equation (6) is eliminated to remove accumulation of errors due to integration.

(B) Flow Chart of Processing in Central Processor Unit

As described hereinbefore, not only the manner of processing carried out in each central processor unit placed in the control mode differs from that placed in the stand-by mode, but also the result of processing obtained in the former case is directed to the use which differs from that in the latter case. Further, the manner of processing carried out in each central processor unit differs depending on the operating conditions of the turbine, that is, depending on whether the turbine is running under load or with increasing speed in the starting stage. The steps of processing carried out in each central processor unit will be described in detail with reference to FIGS. 8A–8D.

Figure 8A:
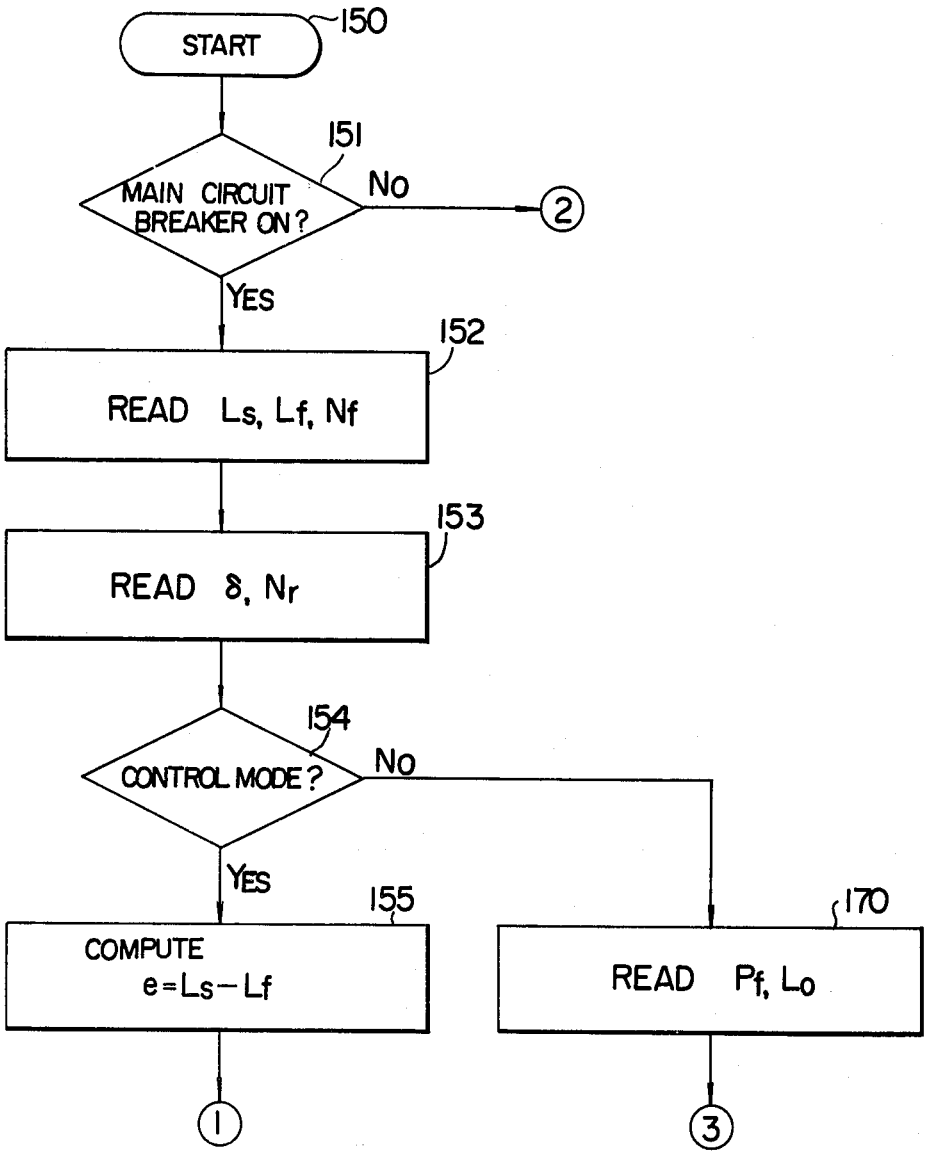
FIGS. 8A to 8D are a flow chart showing the steps of processing by the central processor unit shown in FIG. 7.
Figure 8B:
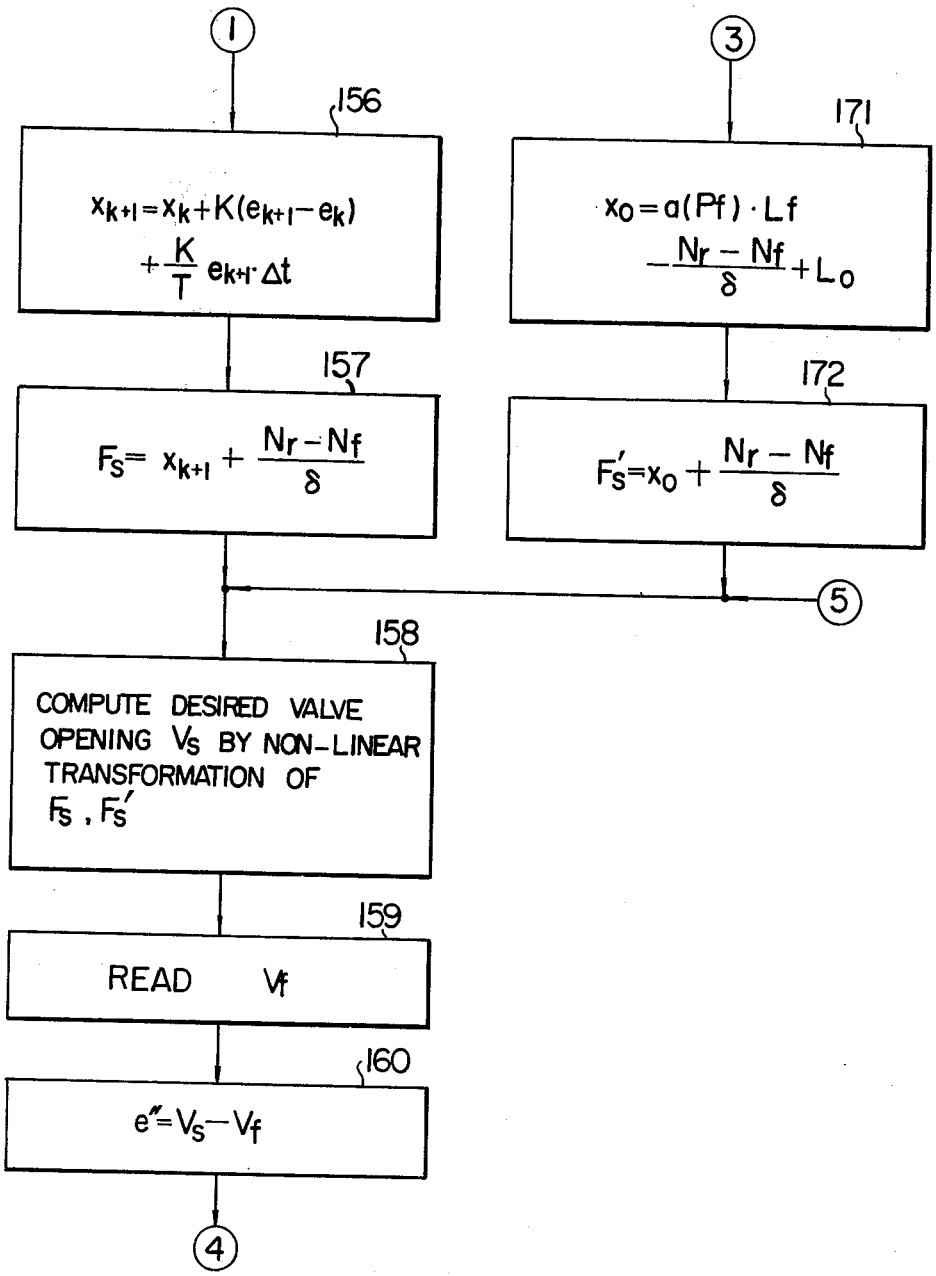

In the step 150 in FIG. 8A, the central processor unit is instructed to start processing and carries out necessary processing according to processing instructions given in the individual succeeding steps. In the step 151, whether the circuit breaker 87 is turned on or not is detected. When the circuit breaker 87 is turned on, an advance to the next step 152 takes place, while when the circuit breaker 87 is not turned on, a jump to the step 190 in FIG. 8D is followed. That is, the turn-on of the circuit breaker 87 indicates the fact that the turbine is running under load, and in this case, processing shown in the step 152 and following steps is carried out. On the other hand, the turbine is running with increasing speed in the starting stage when the circuit breaker 87 is not turned on, and in this case, processing shown in the step 190 and following steps is carried out. The following description refers to the manner of processing carried out when the turbine is operating under load, and then to the manner of processing carried out when the turbine is operating with increasing speed in the starting stage.

When the turbine is running under load, various data required for processing in the central processor unit are read in the steps 152 and 153 in FIG. 8A. Thus, the load setting $L_s$, detected load $L_f$ and detected speed $N_f$ are read in the step 152, and the speed regulation $\delta$ and rated speed $N_r$ are read in the step 153. In the next step 154, whether the specific digital controller is placed in the control mode or stand-by mode is detected. An advance to the next step 155 takes place when the digital controller is placed in the control mode, while a jump to the step 170 occurs when the digital controller is placed in the stand-by mode. When the specific digital controller is placed in the control mode, the error e between the turbine load setting $L_s$ and the detected load $L_f$ is computed in th step 155 as follows:

$$e = L_s - L_f \tag{7}$$

In the step 156 in FIG. 8B, a proportional plus integral value of this error e is computed as follows:

$$x_{k+1} = x_k + K(e_{k+1} - e_k) + \frac{K}{T} e_{k+1} \cdot \Delta t \tag{8}$$

wherein $x_{k+1}$ is the momentary value of the flow rate of main steam to be supplied to the turbine. The above manner of computation is repeated incessantly to seek new values of $x_{k+1}$. In the step 157, the value of $x_{k+1}$ thus computed is used together with the turbine rated speed $N_r$, detected speed $N_f$ and speed regulation $\delta$ so as to finally determine the flow rate $F_s$ of main steam to be supplied to the turbine, as follows:

$$F_s = x_{k+1} + \frac{N_r - N_f}{\delta} \tag{9}$$

On the other hand, when the specific digital controller is placed in the stand-by mode, the detected main steam pressure $P_f$ and flow rate $L_o$ under no load are read in the step 170 in FIG. 8A. In the next step 171 in FIG. 8B, a proportional value including these inputs is computed as follows:

$$x_o = a(P_f)\, L_f - \frac{N_r - N_f}{\delta} + L_o \tag{10}$$

where $x_o$ is the initial value used for the execution of processing to be carried out in the central processor unit when the operating mode of the specific digital controller is switched over from the stand-by mode to the control mode. Therefore, the flow rate $F_s'$ of main steam to be supplied to the turbine is determined as follows:

$$F_s' = x_o + \frac{N_r - N_f}{\delta} \tag{11}$$

It will thus be seen that the equations (9) and (11) determine the flow rates $F_s$ and $F_s'$ of main steam to be supplied to the turbine in the control mode and stand-by mode respectively. In the next step 158, these flow rates $F_s$ and $F_s'$ are transformed into the desired valve opening $V_s$ of the regulating valve 75. In this case, non-linear transformation is carried out on the basis of the known relationship between the flow rate of main steam to be supplied to the turbine and the valve opening of the regulating valve 75 at this flow rate.

In the next step 159, the detected valve opening $V_f$ of the regulating valve 75 is read. In the step 160 following the step 159, the error e'' between the desired valve opening $V_s$ and the detected valve opening $V_f$ of the regulating valve 75 is sought as follows:

$$e'' = V_s - V_f \tag{12}$$

Figure 8C:
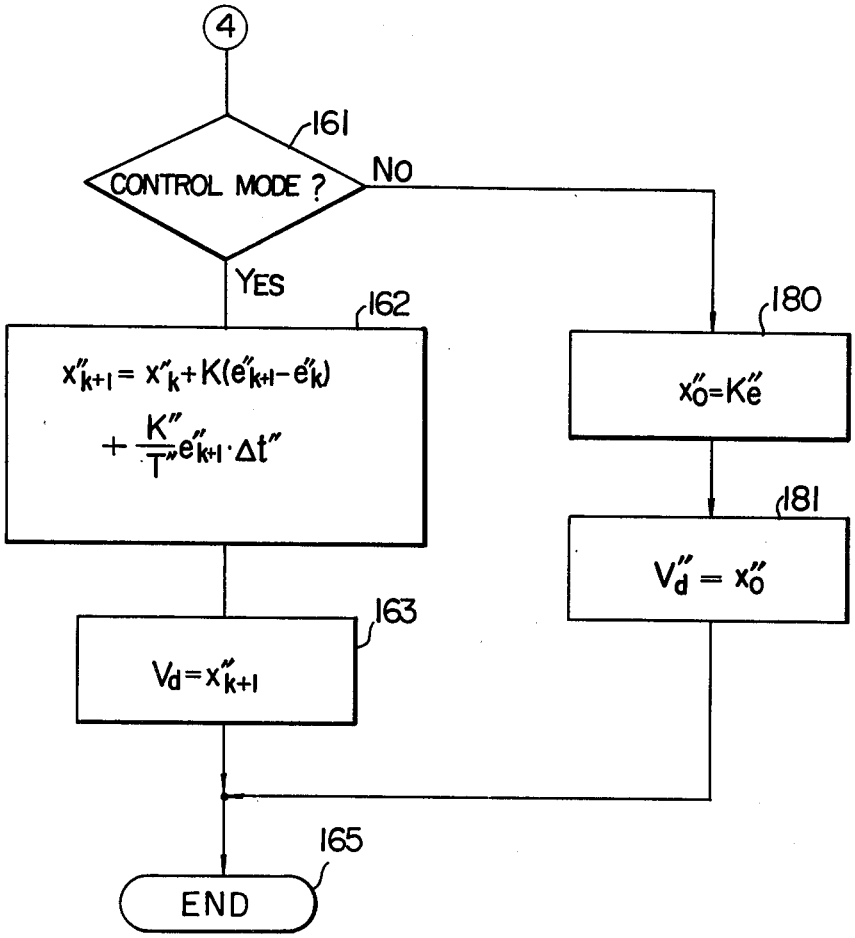
Figure 8D:
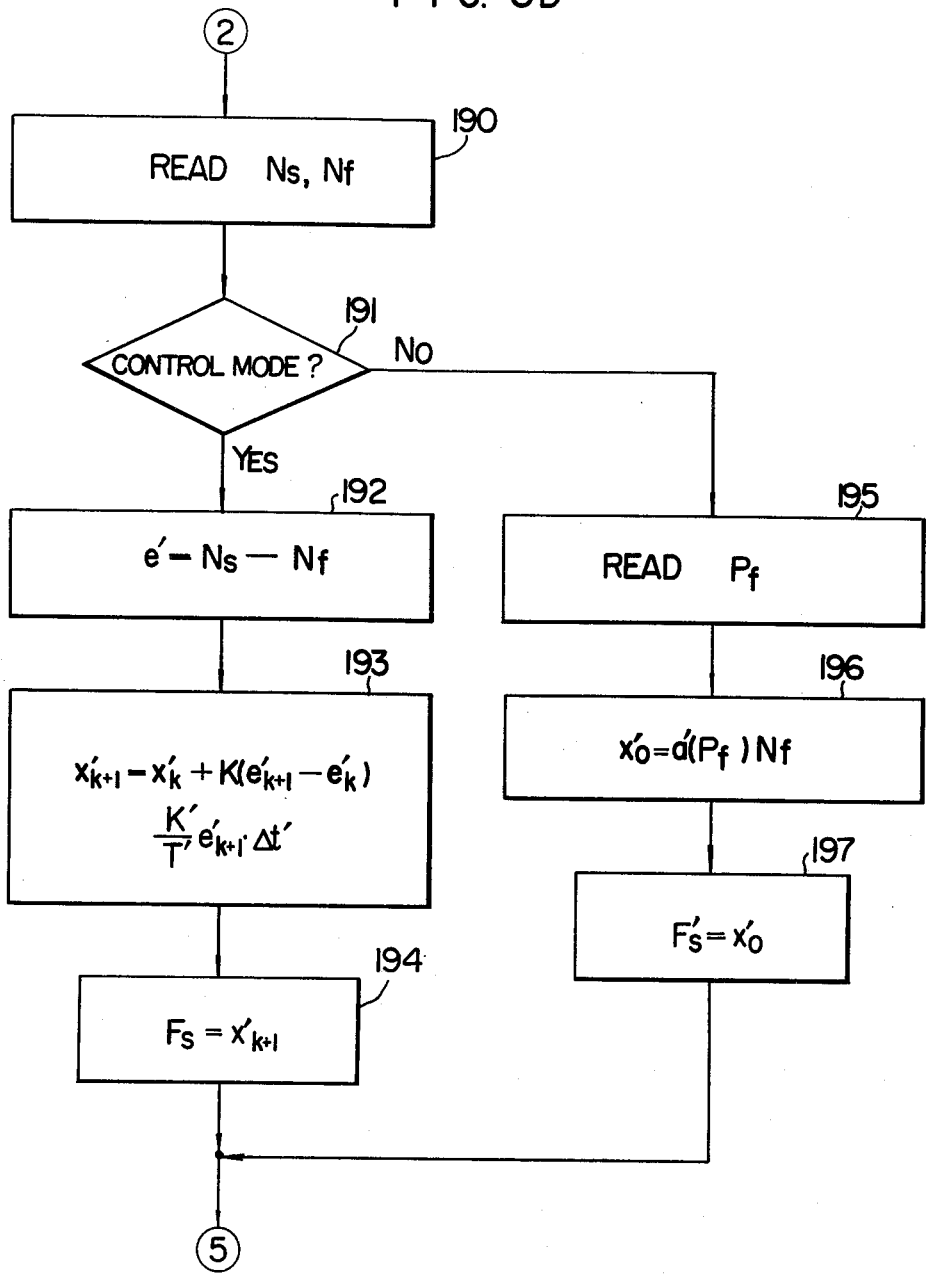

After detecting the error e'' in the step 160, whether the specific digital controller is still placed in the control mode or is now placed in the stand-by mode is detected again in the step 161 in FIG. 8C. An advance to the next step 162 takes place when the digital controller is placed still in the control mode, while a jump to the step 180 is made when the digital controller is placed now in the stand-by mode. When the specific digital controller is placed still in the control mode, a proportional plus integral is computed in the step 162 using the error e'' obtained by the equation (12), as follows:

$$x''_{k+1} = x''_k + K(e''_{k+1} - e''_k) + \frac{K''}{T''} e''_{k+1} \cdot \Delta t'' \tag{13}$$

where $x''_{k+1}$ is the momentary value of the computed valve opening of the regulating valve 75. The above manner of computation is repeated incessantly to seek new values of $x''_{k+1}$. In the step 163, the value of $x''_{k+1}$ thus obtained is used to provide the regulating valve actuating signal $V_d$.

On the other hand, when the specific digital controller is placed in the stand-by mode, a proportional value of the error e'' is computed in the step 180, as follows:

$$x_o'' = K'' \cdot e'' \tag{14}$$

where $x_o''$ is the initial value used for the execution of processing carried out in the central processor unit when the operating mode of the specific digital controller is switched over from the stand-by mode to the control mode. In the step 181, therefore, the regulating valve actuating signal $V_d''$ is determined on the basis of the value of $x_o''$ computed by the equation (14).

The regulating valve actuating signal $V_d$ or $V_d''$ obtained by the steps of processing in the central processor unit in the manner above described is applied through the associated process output unit to the regulating valve opening control unit 90.

When the turbine is running with increasing speed in the starting stage, various data required for processing in the central processor unit are read in the step 190 in FIG. 8D. Thus, the turbine speed setting $N_s$ and detected speed $N_f$ are read in the step 190. In the next step 191, whether the specific digital controller is placed in the control mode or stand-by mode is detected. An advance to the next step 192 takes place when the digital controller is placed in the control mode, while a jump to the step 195 is made when the digital controller is placed in the stand-by mode. When the specific digital controller is placed in the control mode, the error e' between the turbine speed setting $N_s$ and the detected speed $N_f$ is computed in the step 192, as follows:

$$e' = N_s - N_f \tag{15}$$

In the next step 193, a proportional plus integral value of the error e' thus obtained is computed, as follows:

$$x'_{k+1} = x_k + K(e'_{k+1} - e'_k) + \frac{K'}{T'} e'_{k+1} \cdot \Delta t' \tag{16}$$

where $x'_{k+1}$ is the momentary value of the flow rate of main steam to be supplied to the turbine, as in the case of the computation applied when the turbine is running under load. In the next step 194, the value of $x'_{k+1}$ thus obtained is used to determine the flow rate $F_s$.

On the other hand, when the specific digital controller is placed in the stand-by mode, the detected main steam pressure $P_f$ is read in the step 195. In the next step 196, a proportional value including the detected main steam pressure $P_f$ and detected turbine speed $N_f$ is computed, as follows:

$$x_o' = a'(P_f) \cdot N_f \quad (17)$$

where $x_o'$ is the initial value used for the execution of processing to be carried out in the central processor unit when the operating mode of the specific digital controller is switched over from the stand-by mode to the control mode. In the next step 197, the value of $x_o'$ thus obtained is used to determine the flow rate $F_s'$ of main steam to be supplied to the turbine.

It will thus be seen that the flow rates $F_s$ and $F_s'$ of main steam to be supplied to the turbine in the control mode and stand-by mode are determined in the steps 194 and 197 respectively. In the step 158 in FIG. 8B, these flow rates $F_s$ and $F_s'$ are transformed into the desired valve opening $V_s$ of the regulating valve 75. The steps following this step are the same as those explained already with reference to the case in which the turbine is running under load, and any further description is unnecessary. The final level of the regulating valve actuating signal $V_d$ is determined by the steps above described, and the processing in the central processor unit ends at the step 165.

(4) Failure Detecting Unit

The foregoing detailed description has clarified the reason why each of the digital controllers has both the control mode and the stand-by mode, and it has also clarified the steps of processing executed in each central processor unti for each operating mode. The function of the failure detecting unit 40 will next be described in detail, which instructs switch-over between the control mode and the stand-by mode upon detection of failure of one of the digital controllers. It will be recalled from the previous description that the outputs of the two digital controllers 5*a* and 5*b* are displayed on the operator's console 60, and noncoincidence appears between the displays when one of the digital controllers fails to properly operate, so that the operator can readily detect the faulty digital controller. Therefore, the faulty digital controller must be immediately electrically isolated from the other so as to permit repair work by the operator. Thus, the function of the failure detecting unit 40 is such that it generates an instruction signal for switching over the operating mode of the faulty digital controller to the stand-by mode from the control mode, and it generates also another instruction signal for electrically isolating the faulty digital controller from the other so that the faulty digital controller can be repaired by the operator as quickly as possible.

Failures of proper operation of the digital controllers are broadly classified into those attributable to hardware and those attributable to software.

(A) Hardware Failure Detection

Failures attributable to the hardware include improper operation of the power source connected to the hardware units due to, for example, cut-off of the power source itself or interruption of the operation of the cooling fan. They include also trouble occurring in the central processor units themselves, parity error, or trouble occurring in the process input and output units themselves. When such failures occur, abnormality signals appear from the hardware units (the power source, central processor units, etc.) to be detected by the failure detecting unit 40.

(B) Software Failure Detection

Software failure detection includes detection of miscomputation in the central processor units, detection of abnormal operation of the process input and output units, and detection of abnormal data inputs due to faulty operation of the detectors in the turbine plant system. Therefore, various data inputs are checked in order to detect abnormal data, as follows:

(i) Turbine speed . . . The detected value of turbine speed is checked according to the two-out-of-three checking method.

(ii) Main steam pressure . . . The detected value of main steam pressure is converted into a corresponding current value which falls within the range of 4 to 20 mA when the detected main steam pressure falls within the designed range. The converted current value is subject to a rationality check and is found to be abnormal when it is, for example, 0 mA.

(iii) Regulating valve opening . . . The detected regulating valve opening is subject to a followability check so as to check the followability of the actual valve opening to the valve opening instruction.

(iv) Analog output check . . . The important analog output such as the regulating valve actuating signal connected directly to the turbine plant is read according to a program which checks whether or not a predetermined analog output is applied to the turbine plant.

(v) Check with watch dog timer . . . Almost all of the stored programs are periodically started. A program using a watch dog timer is run to check whether these programs are normally started, so as to detect abnormality of the software for some reasons.

(vi) Failure diagnosis program . . . A failure diagnosis program suitably selected from among various ones is run to check whether or not the individual instructions are normally issued.

The programs used for the software failure detection are run utilizing the idle and available band in the period of time occupied by the control program for the electro-hydraulic governor.

In the manner above described, the failure detecting unit 40 is capable of reliably discriminating between the abnormality of the turbine plant system and that of the control system. The failures pointed out in (A) and (B) are classified into serious ones and non-serious ones depending on their degree. The serious failure refers to one which is too serious to permit continuous operation of the turbine plant system, while the non-serious failure refers to one which is not so serious as to interrupt continuous operation of the turbine plant system. Therefore, various states of the digital controllers, including the failures pointed out in (A) and (B), are tabulated in Table 1.

Table 1

| State of DCR's **5a, 5b** | | State symbol |
|---|---|---|
| DCR | Serious failure | A1 |
| 5a | Non-serious failure | A2 |
| | Normal | A3 |
| DCR | Serious failure | B1 |
| 5b | Non-serious failure | B2 |
| | Normal | B3 |

In Table 1, the symbols A1 to A3 and B1 to B3 designate the corresponding states of the digital controllers 5*a* and 5*b*. Depending upon the relationship between these states of the digital controllers 5*a* and 5*b*, the failure detecting unit 40 applies various switch-over instruction signals to the output switching unit 50, as tabulated in Table 2.

Table 2

| Relation between DCR's 5a, 5b | Discrimination | Switch-over instruction |
|---|---|---|
| A1 & B1 | System failure | Turbine trip |
| A1 & B2 | Control failure | Switch-over to DCR 5b |
| A1 & B3 | " | " |
| A2 & B1 | " | Switch-over to DCR 5a |
| A2 & B2 | System failure | No switch-over |
| A2 & B3 | Control failure | Switch-over to DCR 5b |
| A3 & B1 | " | Switch-over to DCR 5a |
| A3 & B2 | " | " |
| A3 & B3 | Normal | No switch-over |

(5) Output Switching Unit

The output switching unit 50 comprises a relay contact such as a mercury relay contact which operates quickly and reliably. In the event of occurrence of failure in one of the digital controllers, the relay in the output switching unit 50 is energized by the switch-over instruction signal applied from the failure detecting unit 40, thereby switching over the contact from the position connected to the output of the faulty digital controller having been placed in the control mode to the position connected to the output of the other digital controller placed in the stand-by mode. Simultaneously with this switch-over operation, the operator detects this failure on the associated display element and starts to make necessary repair work on the faulty digital controller. The operator can freely make this necessary repair work on the faulty digital controller since, at this time, the faulty digital controller is temporarily electrically isolated from the other by the relay unit 91. After completion of the necessary repair, the operator connects the repaired digital controller to the other by the relay unit 91 to restore the same to the on-line position again.

What is claimed is:

1. An electro-hydraulic governor including a turbine operated by a fluid supplied through an input valve, two digital computers disposed independently of each other each for receiving inputs representing the operating conditions of said turbine together with inputs representing the settings provided by the operator and processing said inputs according to a preset program and thereby producing an output representing the result of processing, discriminating means for discriminating between normal operation and abnormal operation of said two digital computers in accordance with the contents of processing of said two digital computers, and output switching means responsive to an instruction signal applied from said discriminating means for applying the output of one of said digital computers as a signal for controlling said input valve;

the improvement wherein each of said digital computers includes input means for receiving inputs representing the operating conditions of said turbine together with inputs representing the settings provided by the operator, processing means for processing the inputs received by said input means according to a preset program and output means for producing an output representing the result of processing by said processing means; said input means, said output means and said processing means of one of said digital computers being operated respectively independently from said input means, said output means and said processing means of the other of said digital computers; and each of said digital computers being supplied with the inputs representing the operating conditions of said turbine through a set of normally closed contacts, and additional means to deal with failure occurring in one of said digital computers by turning off only the normally closed contacts connected to the faulty digital computer to completely disconnect the faulty computer from all of its inputs in accordance with the instruction signal applied from said discriminating means via the output switching means and turning on these normally closed contacts again after completion of necessary repair on said faulty digital computer.

2. An electro-hydraulic governor as claimed in claim 1, wherein said additional means comprises a plurality of relays coupled between the normally closed contacts and the output switching means.

3. A duplex controller system including a controlled system operated by controlling a final control element of the controlled system, two digital computers disposed independently of each other each for receiving inputs representing the operating conditions of said controlled system together with inputs representing the settings provided by the operator and processing said inputs according to a preset program and thereby producing an output representing the result of processing, discriminating means for discriminating between normal operation and abnormal operation of said two digital computers in accordance with the contents of processing of said two digital computers, and output switching means responsive to an instruction signal applied from said discriminating means for applying the output of one of said digital computers as a signal for controlling said final control element;

the improvement wherein each of said digital computers includes input means for receiving inputs representing the operating conditions of said controlled system together with inputs representing the settings provided by the operator, processing means for processing the inputs received by said input means according to a preset program and output means for producing an output representing the result of processing by said processing means; said input means, said output means and said processing means of one of said digital computers being operated respectively independently from said input means, said output means and said processing means of the other of said digital computers; and each of said digital computers being supplied with the inputs representing the operating conditions of said controlled system through a set of normally closed contacts, and additional means to deal with failure occurring in one of said digital computers by turning off only the normally closed contacts connected to the faulty digital computer to completely disconnect the faulty computer from all of its inputs in accordance with the instruction signal applied from said discriminating means via the output switching means and turning on these normally closed contacts again after completion of necessary repair on said faulty digital computer.

4. An electro-hydraulic governor including a turbine operated by a fluid supplied through an input valve, two digital computers disposed independently of each other each for receiving inputs representing the operating conditions of said turbine together with inputs representing the settings provided by the operator and processing said inputs according to a preset program and thereby producing an output representing the result of processing, discriminating means for discriminating between normal operation and abnormal operation of said two digital computers in accordance with the contents of processing of said two digital computers, and output switching means responsive to an instruction signal applied from said discriminating means for applying the output of one of said digital computers as a signal for controlling said input valve;

the improvement wherein each of said digital computers includes input means for receiving inputs representing the operating conditions of said turbine together with inputs representing the settings provided by the operator; processing means for processing the inputs from said input means and including a control mode for subjecting the inputs applied from said input means to proportional plus integral transformation, a stand-by mode for subjecting the inputs applied from said input means to proportional or linear transformation, and instruction means for executing said control mode when the operation of said turbine is controlled by an associated one of said digital computers and for executing said stand-by mode when the operation of said turbine is controlled by the other of said digital computers; and output means for producing the output representing the result of the processing of said processing means;

said input means, said processing means and said output means of one of said digital computers are respectively disposed and operated in an independent relation with said input means, said processing means and said output means of the other of said digital computers; and one of said digital computers changed from stand-by mode into control mode in accordance with the instruction signal applied from said discriminating means executes the proportional plus integral transformation of said control mode by setting the final value obtained by executing said stand-by mode in the same digital computer as an initial value for said control mode.

5. An electro-hydraulic governor as claimed in claim 4, wherein, when said steam turbine is running with increasing speed in the starting stage, the steps of processing in said control mode comprise computing a proportional plus integral value of the error between the speed setting and the detected speed of the turbine for computing the flow rate of the main steam to be supplied to said turbine, converting the resultant value of the flow rate into a regulating valve opening instruction signal, and then computing a proportional plus integral value of the error between the valve opening instructed by this regulating valve opening instruction signal and the detected valve opening for providing the regulating valve actuating signal.

6. An electro-hydraulic governor as claimed in claim 4, wherein, when said steam turbine is running under load, the steps of processing in said control mode comprise computing a proportional plus integral value of the error between the load setting and the detected load of the turbine, dividing the error between the rated speed and the detected speed of the turbine by the speed regulation, adding the former and latter values to compute the flow rate of main steam to be supplied to said turbine, converting the sum into a regulating valve opening instruction signal, and then computing a proportional plus integral value of the error between the valve opening instructed by this regulating valve opening instruction signal and the detected valve opening for providing the regulating valve actuating signal.

7. An electro-hydraulic governor as claimed in claim 4, wherein, when said steam turbine is running with increasing speed in the starting stage, the steps of processing in said stand-by mode comprise subjecting the detected speed of the turbine to linear transformation to provide the initial value used for the computation of the flow rate of main steam to be supplied to the turbine when said stand-by mode is switched over to said control mode, converting the thus computed value of the flow rate into a regulating valve opening instruction signal, and computing a proportional value of the error between the valve opening instructed by this valve opening instruction signal and the detected valve opening for providing the initial value of the regulating valve actuating signal to be applied when said stand-by mode is switched over to said control mode.

8. An electro-hydraulic goveror as claimed in claim 7, wherein the detected pressure of main steam is also taken into account in said linear transformation.

9. An electro-hydraulic governor as claimed in claim 4, wherein, when said steam turbine is running under load, the steps of processing in said stand-by mode comprise subjecting the detected load of the turbine to linear transformation to provide the initial value used for the computation of the flow rate of main steam to be supplied to the turbine when said stand-by mode is switched over to said control mode, converting the thus computed value of the flow rate into a regulating valve opening instruction signal, and then computing a proportional plus integral value of the error between the valve opening instructed by this regulating valve opening instruction signal and the detected valve opening to provide the initial value of the regulating valve actuating signal to be applied when said stand-by mode is switched over to said control mode.

10. An electro-hydraulic governor as claimed in claim 9, wherein the detected pressure of main steam is also taken into account in said linear transformation.

11. A duplex controller system including a controlled system operated by controlling a final control element of said controlled system, two digital computers disposed independently of each other each for receiving inputs representing the operating conditions of said controlled system together with inputs representing the settings provided by the operator and processing said inputs according to a preset program and thereby producing an output representing the result of processing, discriminating means for discriminating between normal operation and abnormal operation of said two digital computers in accordance with the contents of processing of said two digital computers, and output switching means responsive to an instruction signal applied from said discriminating means for applying the output of one of said digital computers as a signal for controlling said final control element;

the improvement wherein each of said digital computers includes input means for receiving inputs representing the operating conditions of said controlled system together with inputs representing the settings provided by the operator; processing means for processing the inputs from said input means and including a control mode for subjecting the inputs applied from said input means to proportional plus integral transformation, a stand-by mode for subjecting the inputs applied from said input means to proportional or linear transformation, and instruction means for executing said control mode when the operation of said controlled system is controlled by an associated one of said digital computers and for executing said stand-by mode when the operation of said controlled system is controlled by the other of said digital computers; and output means for producing the output representing the result of the processing of said processing means;

said input means, said processing means and said output means of one of said digital computers are respectively disposed and operated in an independent relation with said input means, said processing means and said output means of the other of said digital computers; and one of said digital computers changed from stand-by mode into control mode in accordance with the instruction signal applied from said discriminating means executes the proportional plus integral transformation of said control mode by setting the final value obtained by executing said stand-by mode in the same digital computer as an initial value for said control mode.

12. A duplex controller system according to claim 11, wherein said discriminating means upon discriminating that the one of said computers placed in the control mode is abnormally operating applies an instruction signal to said output switching means for enabling disconnection of the abnormally operating control means and switch-over of operating mode of the other of said computers from the stand-by mode to the control mode.

13. A duplex controller system according to claim 12, wherein said duplex controller system is an electro-hydraulic governor, said controlled system is a steam turbine, and each of said computers in the control mode thereof provides an actuating signal for a main steam flow regulating valve of said turbine system.

14. An electro-hydraulic governor as claimed in claim 13, wherein, when said steam turbine is running with increasing speed in the starting stage, the steps of processing in said control mode comprise computing a proportional plus integral value of the error between the speed setting and the detected speed of the turbine for computing the flow rate of main steam to be supplied to said turbine, converting the resultant value of the flow rate into a regulating valve opening instruction signal, and then computing a proportional plus integral value of the error between the valve opening instructed by this regulating valve opening instruction signal and the detected valve opening for providing the regulating valve actuating signal.

15. An electro-hydraulic governor as claimed in claim 13, wherein when said steam turbine is running under load, the steps of processing in said control mode comprise computing a proportional plus integral value of the error between the load setting and the detected load of the turbine, dividing the error between the rated speed and the detected speed of the turbine by the speed regulation, adding the former and latter values to compute the flow rate of main steam to be supplied to said turbine, converting the sum into a regulating valve opening instruction signal, and then computing a proportional plus integral value of the error between the valve opening instructed by this regulating valve opening instruction signal and the detected valve opening for providing the regulating valve actuating signal.

16. An electro-hydraulic governor as claimed in claim 13, wherein, when said steam turbine is running with increasing speed in the starting stage, the steps of processing in said stand-by mode comprise subjecting the detected speed of the turbine to linear transformation to provide the initial value used for the computation of the flow rate of main steam to be supplied to the turbine when said stand-by mode is switched over to said control mode, converting the thus computed value of the flow rate, into a regulating valve opening instruction signal, and computing a proportional value of the error between the valve opening instructed by this valve opening instruction signal and the detected valve opening for providing the initial value of the regulating valve actuating signal to be applied when said stand-by mode is switched over to said control mode.

17. An electro-hydraulic governor as claimed in claim 16, wherein the detected pressure of main steam is also taken into account in said linear transformation.

18. An electro-hydraulic governor as claimed in claim 13, wherein, when said steam turbine is running under load, the steps of processing in said stand-by mode comprise subjecting the detected load of the turbine to linear transformation to provide the initial value used for the computation of the flow rate of main steam to be supplied to the turbine when said stand-by mode is switched over to said control mode, converting the thus computed value of the flow rate into a regulating valve opening instruction signal, and then computing a proportional plus integral value of the error between the value opening instructed by this regulating valve opening instruction signal and the detected valve opening to provide the initial value of the regulating valve actuating signal to be applied when said stand-by mode is switched over to said control mode.

19. An electro-hydraulic governor as claimed in claim 18, wherein the detected pressure of main steam is also taken into account in said linear transformation.

20. An electro-hydraulic governor as claimed in claim 13, wherein a push button actuated display is actuated on said operator's console to bring coincidence between the information stored in said computers before restoring said disconnected control means to the original on-line position after completion of the necessary repair.

21. An electro-hydraulic governor as claimed in claim 20, wherein said push button actuted display comprises a pair of display lamps for displaying the operating states of said computers, and the actuation is completed when said display lamps give the same display.

22. An electro-hydraulic governor as claimed in claim 20, wherein said push button actuated display comprises a two-pointer meter for displaying the operating states of said computers, and the actuation is completed when the two pointers of said meter point to the same position.

23. A duplex controller system for controlling the operation of a controlled system comprising:

first and second independent control means disposed independently of each other and including respectively first and second input means, first and second processing means and first and second input means;

said first and second input means being disposed independently of each other for receiving inputs representing at least the operating conditions of said controlled system;

said first and second processing means being disposed independently of each other and connected to said first and second input means, respectively, for processing the inputs from said first and second input means according to a preset program;

said first and second output means being disposed independently of each other and connected to said first and second processing means, respectively, for producing an output representing the result of processing by said respective processing means;

output switching means for selectively applying the output of one of said first and second independent control means as a controlled system control signal to said controlled system, the one of said first and second control means being a normaly operating control means;

discriminating means for discriminating between normal operation and abnormal operation of said first and second independent control means and for providing an instruction signal in accordance with the discrimination, said output switching means being responsive to the instruction signal from said discriminating means by applying the output of the one of said first and second control means as the controlled system control signal to said controlled system at least when the other of said first and second control means is discriminated to have abnormal operation;

wherein said first and second control means further include respectively first and second memory means and first and second transmitting means, said first and second input means receiving inputs representing the operating conditions of said controlled system as first inputs thereto and further receiving inputs representing settings provided by an operator as second inputs thereto, with said duplex controller system further comprising:

operating console means including a plurality of display means each having first and second display elements and first and second switches associated with said first and second display elements, respectively, each of said first and second switches of each of said plurality of display means having first and second conditions and being selectively settable in one of said first and second conditions by the operator, the conditions of said first and second switches of each of said plurality of display means being applied to said first and second input means, respectively, as said second inputs thereto;

said first and second memory means being provided for respectively storing said conditions of said first and second switches of each of said plurality of display means received through said first and second input means, respectively, said first and second memory means providing said stored conditions to said first and second processing means, respectively, for processing said stored conditions in said processing means;

said first and second transmitting means being provided for transmitting said conditions of said first and second switches stored in said first and second memory means to said first and second display elements associated with said first and second switches through said first and second output means, respectively, thereby indicating the conditions of said first and second switches in said associated first and second display elements, respectively; and further wherein once said output switching means applies the output of one of said first and second control means instead of the output of the other of said first and second control means in response to said instruction signal from said discriminating means when the one of said control means is discriminated to have a normal operation and the other of said control means is discriminated to have an abnormal operation, one of said first and second switches of each of said plurality of display means associated with the other of said first and second control means is set in the same condition as the other of said first and second switches so as to provide the same display on said first and second display elements associated with said first and second switches after removal of the abnormal operation of the other of said first and second control means.

24. A duplex controller system according to claim 23, wherein said duplex controller system is an electro-hydraulic governor and said controlled system is a steam turbine.

25. A duplex controller system for controlling the operation of a controlled system comprising:

first and second independent control means disposed independently of each other and including respectively first and second input means, first and second processing means and first and second output means;

said first and second input means being disposed independently of each other for receiving inputs representing at least the operating conditions of said controlled system;

said first and second processing means being disposed independently of each other and connected to said first and second input means, respectively, for processing the inputs from said first and second input means according to a preset program;

said first and second output means being disposed independently of each other and connected to said first and second processing means, respectively, for producing an output representing the result of processing by said respective processing means;

output switching means for selectively applying the output of one of said first and second independent control means as a controlled system control signal to said controlled system, the one of said first and second control means being a normally operating control means;

discriminating means for discriminating between normal operation and abnormal operation of said first and second independent control means and for providing an instruction signal in accordance with the discrimination, said output switching means being responsive to the instruction signal from said discriminating means for applying the output of the one of said first and second control means as the controlled system control signal to said controlled system at least when the other of said first and second control means is discriminated to have abnormal operation;

wherein said first and second control means further include, respectively, first and second memory means and first and second driving means, said first and second input means receiving inputs representing the operating conditions of said controlled system as first inputs thereto and further receiving inputs representing settings provided by an operator as second inputs thereto, said duplex controller system further comprising:

operator console means including first and second switches and a two-pointer meter having first and second pointers associated with said first and second switches, respectively, each of said first and second switches having first and second conditions and being selectively settable from the first condition to the second condition by the operator, the conditions of said first and second switches being applied to said first and second input means, respectively, as said second inputs;

said first and second memory means being provided for receiving the conditions of said first and second switches through said first and second input means, respectively, and for storing first and second signals corresponding to the time periods during which said first and second switches are in said second condition, respectively, said first and second memory means providing said stored first and second signals to said first and second processing means, respectively, for processing said stored signals in said respective processing means:

said first and second driving means being provided for moving said first and second pointers to a position corresponding to said stored first and second signals, respectively; and further wherein once said output switching means applies the output of one of said first and second control means instead of the output of the other of said first and second control means in response to said instruction signal from said discriminating means when the one of said control means is discriminated as having normal operation and the other of said control means is discriminated as having abnormal operation, one of said first and second switches associated with the other of said first and second control means is set in the same condition as the other of said first and second switches in order for said two pointers to indicate the same position in said two-pointer meter after removing the abnormal operation of the other of said first and second control means.

26. A duplex controller system according to claim 25, wherein said duplex controller system is an electro-hydraulic governor and said controlled system is a steam turbine.

* * * * *